US007827912B2

(12) United States Patent
Siman-Tov et al.

(10) Patent No.: US 7,827,912 B2
(45) Date of Patent: Nov. 9, 2010

(54) HYBRID OPTICAL HEAD FOR DIRECT ENGRAVING OF FLEXOGRAPHIC PRINTING PLATES

(75) Inventors: Alon Siman-Tov, Or-Yehuda (IL); Haim Chayet, Nes Niona (IL)

(73) Assignee: Eastman Kodak Company, Rochester, NY (US)

( * ) Notice: Subject to any disclaimer, the term of this patent is extended or adjusted under 35 U.S.C. 154(b) by 707 days.

(21) Appl. No.: 11/615,025

(22) Filed: Dec. 22, 2006

(65) Prior Publication Data

US 2008/0153038 A1 Jun. 26, 2008

(51) Int. Cl.
*B41C 1/05* (2006.01)
*B41C 1/02* (2006.01)
*B41N 1/12* (2006.01)

(52) U.S. Cl. ..... 101/401.1; 430/306

(58) Field of Classification Search ..... None
See application file for complete search history.

(56) References Cited

U.S. PATENT DOCUMENTS

| | | | | |
|---|---|---|---|---|
| 5,370,961 | A | 12/1994 | Zaretsky et al. | |
| 5,635,086 | A * | 6/1997 | Warren et al. | 219/121.39 |
| 5,968,656 | A | 10/1999 | Ezenyilimba et al. | |
| 6,150,629 | A | 11/2000 | Sievers | |
| 6,421,522 | B2 | 7/2002 | Henderson et al. | |
| 6,857,365 | B2 | 2/2005 | Juffinger et al. | |
| 7,265,772 | B2 * | 9/2007 | Sievers | 347/233 |
| 2001/0052924 | A1 | 12/2001 | Steinke et al. | |
| 2004/0255805 | A1 * | 12/2004 | Campbell et al. | 101/395 |
| 2005/0150407 | A1 * | 7/2005 | Kuczynski et al. | 101/401.1 |
| 2005/0221278 | A1 | 10/2005 | Iwatani et al. | |
| 2006/0065147 | A1 | 3/2006 | Ogawa | |
| 2006/0096473 | A1 * | 5/2006 | Beisswenger et al. | 101/3.1 |
| 2006/0098934 | A1 * | 5/2006 | Eyal et al. | 385/146 |
| 2006/0132592 | A1 | 6/2006 | Sievers | |
| 2006/0203861 | A1 | 9/2006 | Ogawa | |

FOREIGN PATENT DOCUMENTS

| | | | |
|---|---|---|---|
| DE | 101 05 979 | A1 | 8/2002 |
| EP | 1 155 844 | A2 | 11/2001 |
| WO | WO 02064370 | A1 * | 8/2002 |

OTHER PUBLICATIONS

U.S. Appl. No. 11/353,217 by Eastman Kodak Company, Kodak Docket 91832/JLT, Title: Flexographic Printing Plate Precursor and Imaging Method, Filed Feb. 13, 2006.
Website: http://www.jdsu.com/index.cfm?productid=605 &pagepath=products/commercial_lasers/products/laser_diodes &if=3008 (JDSU Commercial Lasers—Diode Laser, 9xnm, Fiber-Coupled, 6.5 W, Dec. 2006.
Website: http://www.dilas.de/products/products.html (DILAS products), Dec. 2006.
Website: http://www.scd.co.il/lapid.asp (SD SemiConductor Devices—LAPID, Dec. 2006.

* cited by examiner

*Primary Examiner*—Daniel J Colilla
(74) *Attorney, Agent, or Firm*—Nelson Adrian Blish

(57) ABSTRACT

An optical imaging head for direct engraving of flexographic printing plates, comprising: at least two groups of radiation sources, each group comprising at least one radiation source, wherein the radiation sources within each group emit radiation having the same intensity and spot size, different from the intensity and spot size of radiation sources in the other groups, said groups of radiation sources operating simultaneously.

14 Claims, 10 Drawing Sheets

HYBRID OPTICAL HEAD FOR DIRECT ENGRAVING OF FLEXOGRAPHIC PRINTING PLATES

CROSS REFERENCE TO RELATED APPLICATIONS

Reference is made to commonly-assigned copending U.S. patent application Ser. No. 11/353,217, filed Feb. 13, 2006, entitled FLEXOGRAPHIC PRINTING PLATE PRECURSOR AND IMAGING METHOD, by Kimelblat et al., the disclosure of which is incorporated herein.

FIELD OF THE INVENTION

This invention relates to an optical printing head and methods for direct engraving of flexographic printing plates.

BACKGROUND OF THE INVENTION

Direct engraving of a flexography plate requires carving three dimensional (3-D), on plate material, directly with a laser system. This is remarkably different from two dimensional (2-D) imaging techniques that require post processing steps to produce the 3-D features.

This difference introduces several challenges for the laser imaging system:

1. The laser system must have sufficient power to ablate the material; and
2. The laser spot should be small enough to achieve the fine detail required in quality printing.

Although high power density does not necessary conflict with laser focusability, from a practical perspective, these lasers offer significantly higher cost per watt of output optical power than broad spot lasers. As a result, it is desirable to operate with broad laser sources, that may produce high output optical power, rather than with small spot sources, that may have high power density but relatively low total power output.

It is therefore appealing to use a laser system that combines the characteristics of a fine spot laser source to process areas which require fine detail screening and a broad spot laser source for portions of the image where features comprise large solid areas.

U.S. Pat. No. 6,857,365 to Juffinger et al provides a method of producing a printing block by introducing a relief is into a surface of a printing block blank. To form the relief, material of the printing block blank is removed along tracks by radiation. The relief regions may be formed at different depths along one and the same track by frequent exposure to radiation by radiation sources mounted on the same optical head.

U.S. Published application No. 2006/0065147 to Ogawa provides a method of engraving a flexo direct printing plate in two processes. One is a precision engraving process for irradiating the flexo direct printing plate at a precision engraving pixel pitch with a precision engraving beam having a small diameter, to engrave the plate to a maximum depth. The other is a coarse engraving process for irradiating the flexo direct printing plate at a coarse engraving pixel pitch larger than the precision engraving pixel pitch, with a coarse engraving beam having a large diameter, to engrave the plate to a relief depth. A variable beam expander changes the diameter of the laser beam emitted from the single laser source.

U.S. Pat. No. 6,150,629 to Sievers provides a laser engraving machine used for engraving a workpiece surface by a modulated laser beam in order to form a desired profile in the workpiece surface. The fine structures of the profile are formed by the laser beam of a first laser which is modulated by an acoustooptic modulator with relatively high modulation frequency, while the deep areas of the desired profile are formed by the laser beam of a second laser, for which purpose the modulator, on the one hand, and the second laser beam source, on the other hand, are driven by interrelated but separate control signals. The two perpendicular polarized laser beams from the modulator and the second laser beam source are transmitted and reflected by a selective mirror, respectively, and applied commonly via a single optical system to the workpiece surface to be machined.

U.S. Published patent application No. 20060132592 to Sievers provides for the transferring of an image by the combined flux from two or more beams of light. Particular embodiments ablate the mask printing plates for CTP systems by the combined illumination from a first, broad beam and a plurality of controllable, pulsed beams that co-illuminate the plate with the first beam.

U.S. Published patent application No. 20060203861 to Ogawa provides a laser engraving machine having a recording drum rotatable with a flexo sensitive material mounted peripherally thereof, and a recording head movable parallel to the axis of this recording drum. The recording head includes a first laser source for emitting a precision engraving beam L1, a second laser source for emitting a coarse engraving beam L2, an AOM for modulating the precision engraving beam L1, an AOD for causing the precision engraving beam L1 to scan axially of the recording drum, an AOM for modulating the coarse engraving beam L2, a synthesizing device, and an optic for condensing the precision engraving beam L1 and coarse engraving beam L2 synthesized by the synthesizing device on the flexo sensitive material.

SUMMARY OF THE INVENTION

The present invention is a radiation system that combines the characteristics of a fine spot radiation source to process areas that require fine detail screening and a broad spot radiation source to process areas that comprise large substantially solid areas.

In particular, system for engraving flexographic printing plates, comprises a first group of one or more radiation sources each emitting radiation having substantially the same intensity; a first one or more optical elements coupled to the first group of one or more radiation sources for imaging the radiation emitted from the first group of one or more radiation sources onto a flexographic printing plate; a second group of one or more radiation sources each emitting radiation having substantially the same intensity; and a second one or more optical elements coupled to the second group of one or more radiation sources for imaging the radiation emitted from the second group of one or more radiation sources onto the flexographic printing plate, wherein the intensity and spot size of the first group of one or more radiation sources is different from the intensity and spot size of the second group of one or more radiation sources, and wherein the first and second groups of radiation sources operate simultaneously.

Additionally, a method for engraving flexographic printing plates, comprises emitting radiation having substantially the same intensity by each of a first group of one or more radiation sources; imaging the radiation emitted from the first group of one or more radiation sources onto a flexographic printing plate by a first one or more optical elements coupled to the first group of one or more radiation sources; emitting radiation having substantially the same intensity by each of a second group of one or more radiation sources; and imaging the radiation emitted from the second group of one or more radiation sources onto the flexographic printing plate by a second one or more optical elements coupled to the second group of one or more radiation sources, wherein the intensity and spot size of the first group of one or more radiation sources is different from the intensity and spot size of the second group of one or more radiation sources, and wherein the first and second groups of radiation sources operate simultaneously.

DETAILED DESCRIPTION OF THE INVENTION

Figure 1:
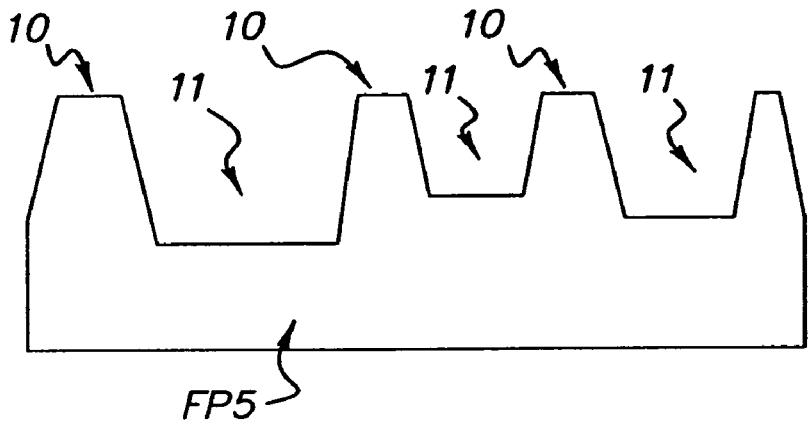
FIG. 1 is a diagram showing blank and elevated ink transfer areas on a flexographic plate.

The combination of radiation sources with high power broad spots and low power fine spots, referred to as a Hybrid Optical Head System (HOHS), is well suited for 3-D processing of direct engraving flexography applications. Referring to FIG. 1, because a flexographic plate (FP) 5 is pressed directly onto printed media, such as, for example, paper, packaging material and the like (not shown), areas 10 that transfer ink to the printed media need to be elevated from blank areas 11 which do not transfer ink. The required depth of the blank areas 11 is such that when the FP 5 is pressed against another surface, the blank areas 11 should be kept out of contact with the surface.

Figure 2:
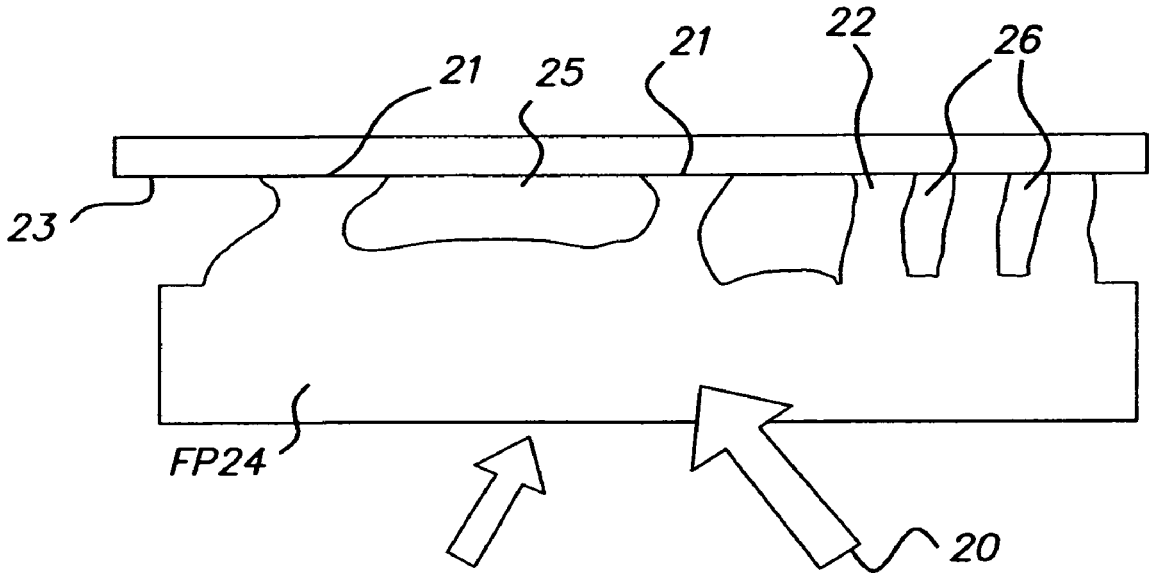
FIG. 2 is a diagram showing a flexographic plate pressed against a surface.

Referring to FIG. 2, FP 24 is being pressed firmly against contact surface 23 by pressure 20. Because FP 24 is deformable, imaging features 21 separated by large blank area 25 (typically used to produce large solid areas in imaging) will be deformed more strongly and pushed closer to contact surface 23 than imaging features 22 that are separated by small blank area 26 (typically used to produce fine detail areas in imaging). Therefore, large blank area 25 must maintain greater depth than small area 26 to prevent contact with the contact surface 23. Therefore, it follows that small blank area 26 may be engraved by the radiation system to a shallower depth than that required for large blank area 25. The HOHS takes advantage of the fact that large solid areas need to be processed to a depth which is greater than that required for fine detail.

The HOHS may be configured with at least two groups of radiation sources, the groups comprising at least one radiation source, wherein the radiation sources within the groups emit radiation having the same intensity and spot size, different from the intensity and spot size of radiation sources in other groups, wherein the groups of radiation sources are operating simultaneously. Radiation sources include, but are not limited to, lasers, laser diodes, multi emitter laser diodes laser bars, laser stacks, fiber lasers and the like. For example, a lower power fine laser source may assist in processing solid areas; however, a high power broad laser source may only operate in areas that are greater than or equal to its spot size. The laser sources, fine and broad, may be integrated into a single optical head, or separated into their own separate mounted heads. In each configuration, the laser sources are controlled and driven independently of each other.

The HOHS may, for example, utilize one of the following sources:

1. Fiber coupled single emitter diode laser of 100 micro meter aperture capable of emitting 6.5 W, such as those available from JDSU: Laser Diode, 9xx nm, Fiber-Coupled, 6.5 W. Description is available at: http://www jdsu.com/index.cfm?productid=605&pagepath=Products/Commercial Lasers/Products/Laser_Diodes&id=2008)

This particular JDSU laser source may be imaged to a fine spot in the order of tens of micrometers depending on the imaging optics, without seriously compromising focus depth.

2. A semiconductor bar that can provide tens of watts of output power. Array or stack of several bars can provide hundreds of watts into a large spot. A single bar is capable of producing a 400-micrometer spot without a significant compromise in focus depth. Additionally, a single bar may engrave coarse features to significant depth within a short exposure time.

A fine laser source, or a multiplicity of fine laser sources, may comprise diode lasers having a single emitter, such as, for example:

Laser Diode, 9xx nm, Fiber-Coupled, 6.5 W. Available from: JDSU (http://www jdsu.com/index.cfm?productid=605&pagepath=Products/Commercial_Lasers/Products/Laser_Diodes&id=2008).

Both fine and broad source lasers are available in a fiber-coupled and non-fiber-coupled configurations. In the fiber-coupled configuration, the laser is coupled to a fiber using a separate focusing lens or a lens defined by processing the fiber end to a surface capable of refracting the light into the fiber. The size of the aperture emerging from the fiber is determined by the radial dimension of the fiber. Since the light that is output from the aperture diverges, it needs to be imaged by using a lens, or system of lenses, to result in the desired spot size.

Figure 3:
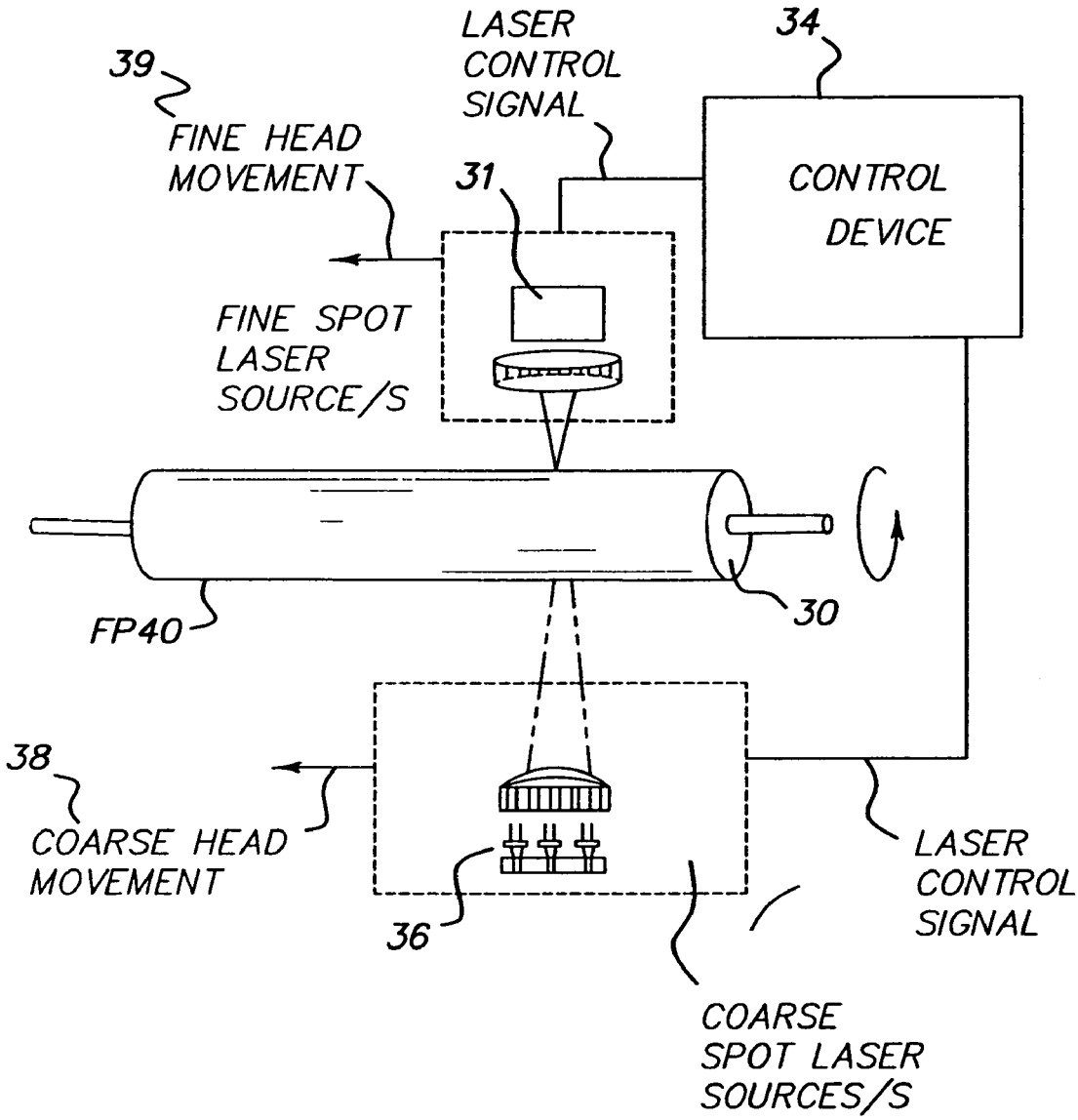
FIG. 3 is a diagram of the Hybrid Optical Head concept arranged on two separate optical carriages.

FIG. 3 illustrates one embodiment of a HOHS where fine laser source 31 and broad laser source 36 are mounted on carriages 39 and 38, respectively, which move along the longitudinal axis of a rotating drum 30 on which FP 40 is mounted. Laser sources 31 and 36 are controlled by control device 34 and carriages 39 and 38 may be placed independently of each other, at different locations with respect to the rotating drum 30.

In operation, FP 40 is attached to drum 30 and then spun. While spinning, control device 34 directs laser source 36 to ablate certain large areas that are greater than or equal to the spot size of the laser source 36; while laser source 31 is directed to ablate certain small areas, areas requiring fine detail and large areas where laser source 31 is directed to operate. Laser sources 31 and 36 are moved on their respective carriage 39 and 38, respectively, so as to locate the laser sources 31 and 36 in the area where they need to operate.

Figure 4:
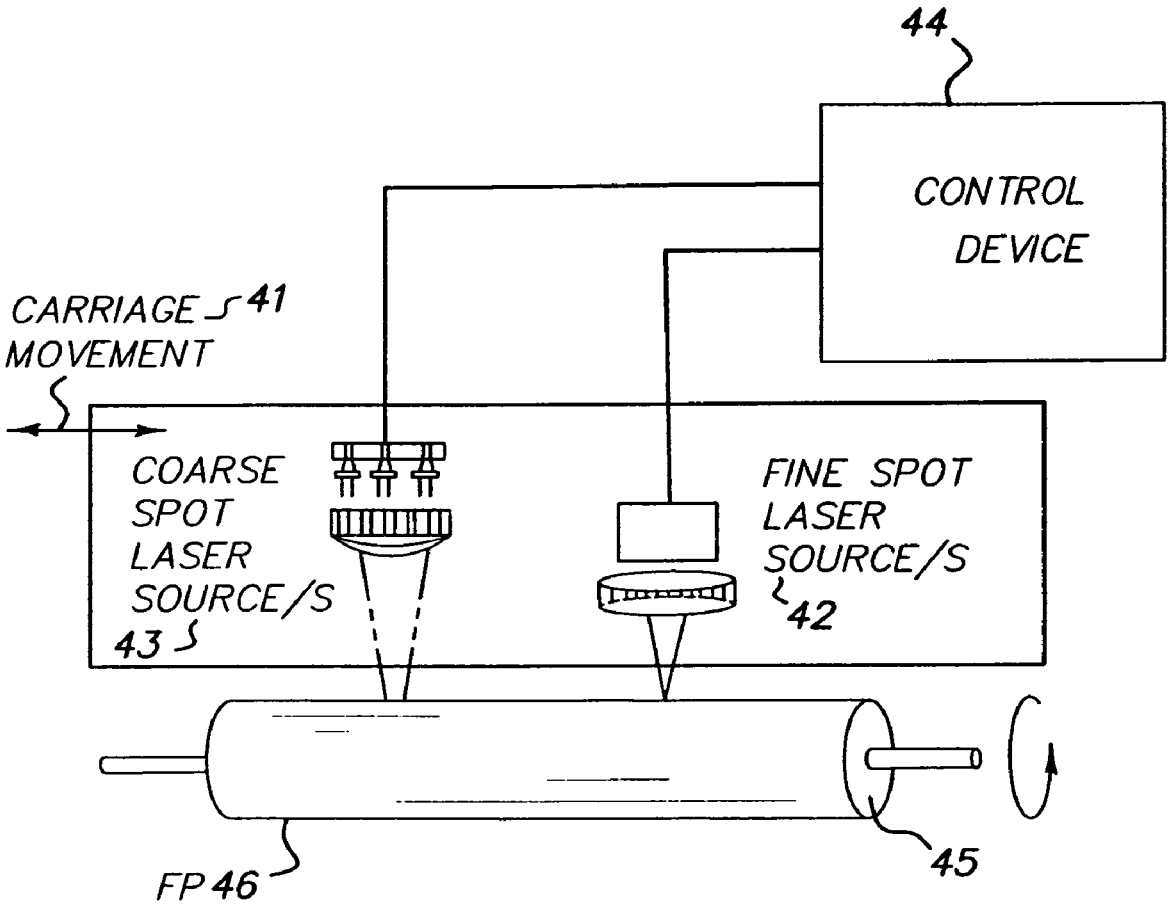
FIG. 4 is a diagram of the Hybrid Optical Head concept arranged on one carriage.

FIG. 4 illustrates another embodiment of the HOHS where fine laser source 42 and broad laser source 43 are mounted on the same carriage 41. Lasers 42 and 43 are controlled independently by controller device 44, according to the data containing details of the image, for engraving on FP 46 mounted on drum 45.

In operation, FP 46 is attached to drum 45 and then spun. While spinning, control device 44 directs laser 43 to ablate certain large areas that are greater than or equal to the spot size of the laser 43; while laser 42 is directed to ablate certain small areas, areas requiring fine detail and large areas where laser 42 is directed to operate. Laser sources 42 and 43 are moved on carriage 41 so as to locate the lasers 42 and 43 in the area where they need to operate.

Figure 5:
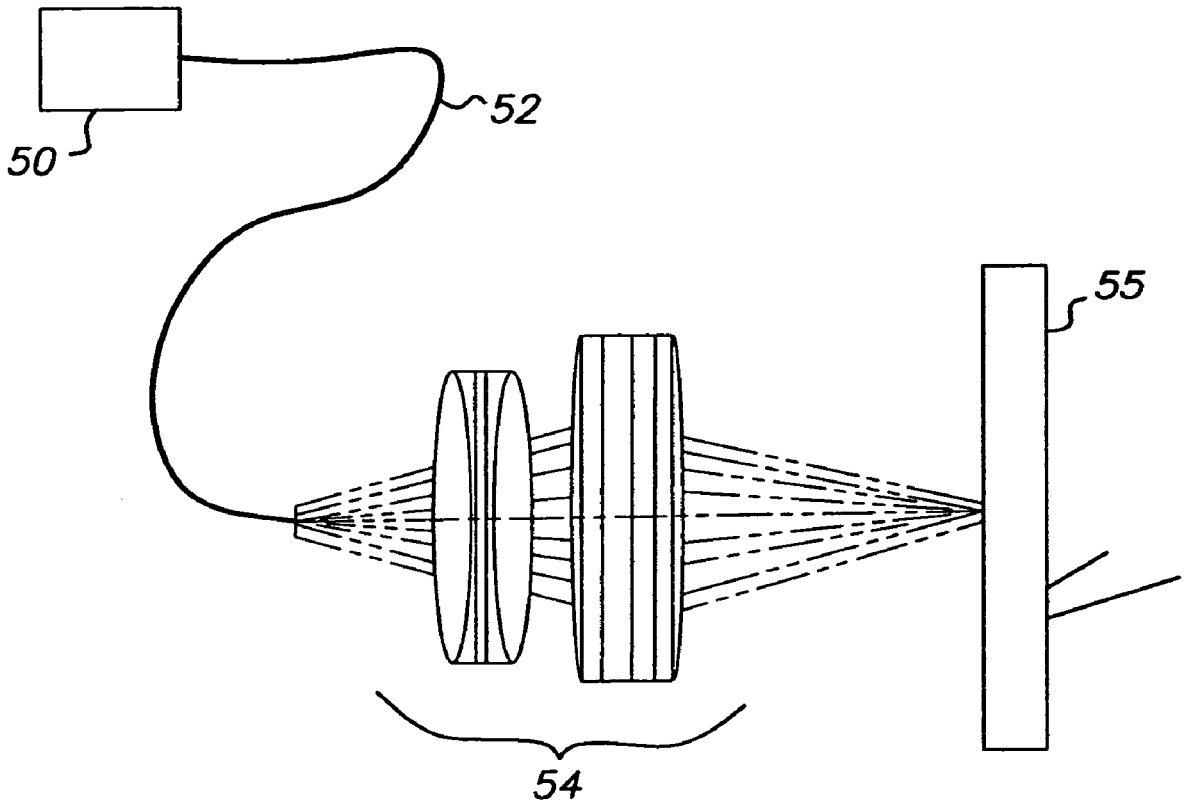
FIG. 5 shows a fiber coupled diode imaged by an optical system onto the flexographic plate.

FIG. 5 illustrates a fiber coupled diode laser 50 coupled to fiber 52, fiber 52 coupled to imaging optical system 54 which achieves a spot of desired dimension to focus and engrave on the engraved media 55. The fiber 52 in this embodiment may be a single mode laser source, multimode fiber or bundle of fibers for a multimode laser source.

Figure 6:
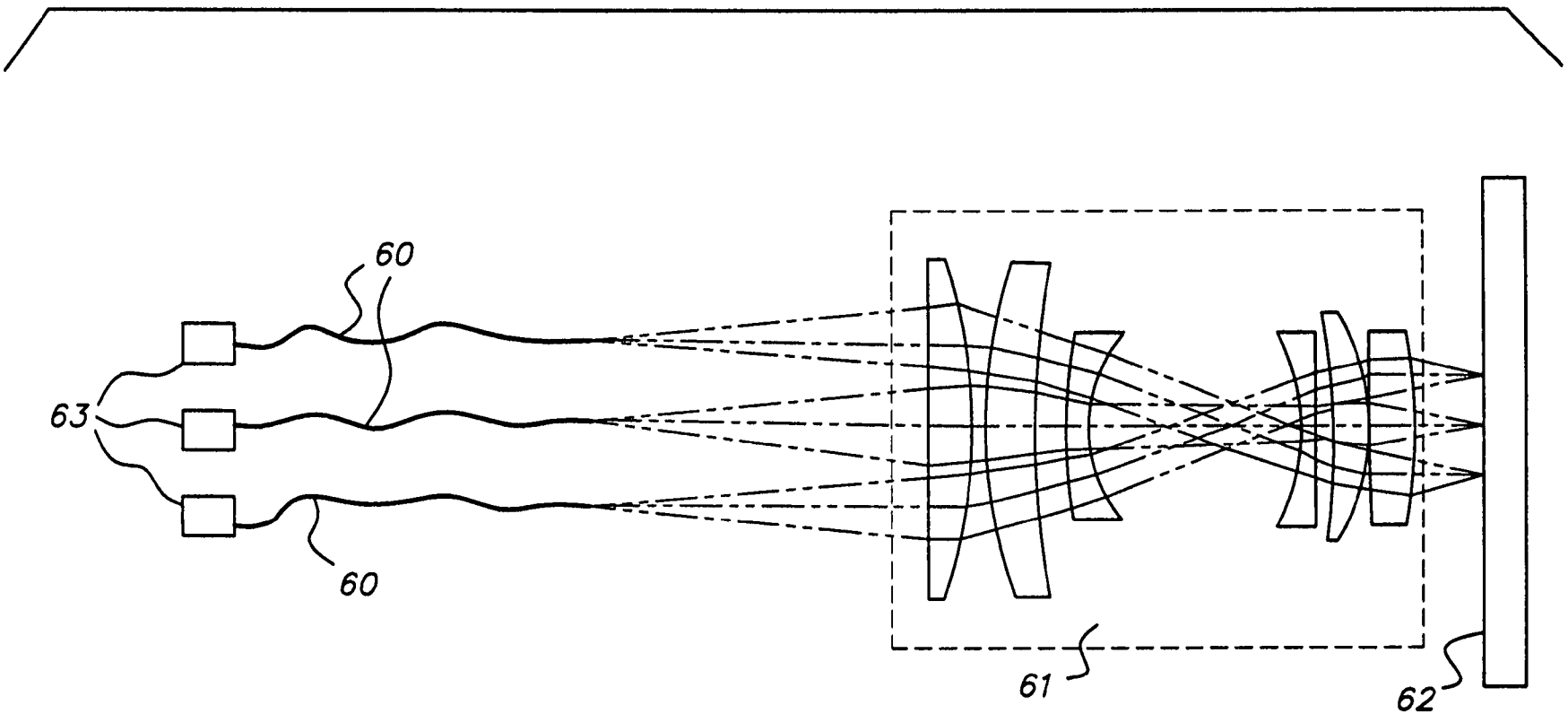
FIG. 6 is a diagram showing a plurality of fiber coupled diode lasers and fibers arranged in an array and imaged onto the flexographic plate by a telecentric lens.

FIG. 6 describes another embodiment wherein a multiplicity of fiber coupled diode lasers 63 are used. The fibers 60 are arranged in an array and can be imaged by a lens or system of lenses 61 on the engraved media 62. In an example, the system of lenses 61 may be configured as a telecentric lens.

In another example, the diode laser 63 or multiplicity of diode lasers 63 may be other than fiber coupled diodes. The beam emitted from a diode laser spreads out as it leaves its front facet and needs to be captured by a lens positioned in close proximity to the emitter. Very often the light leaves the lens collimated, namely, propagating along the optical axis with minimum divergence. The collimating lens may include a single lens element or several elements. In case the laser diode 63 is other than fiber coupled, additional elements are required for producing circular beam profile.

Figure 7:
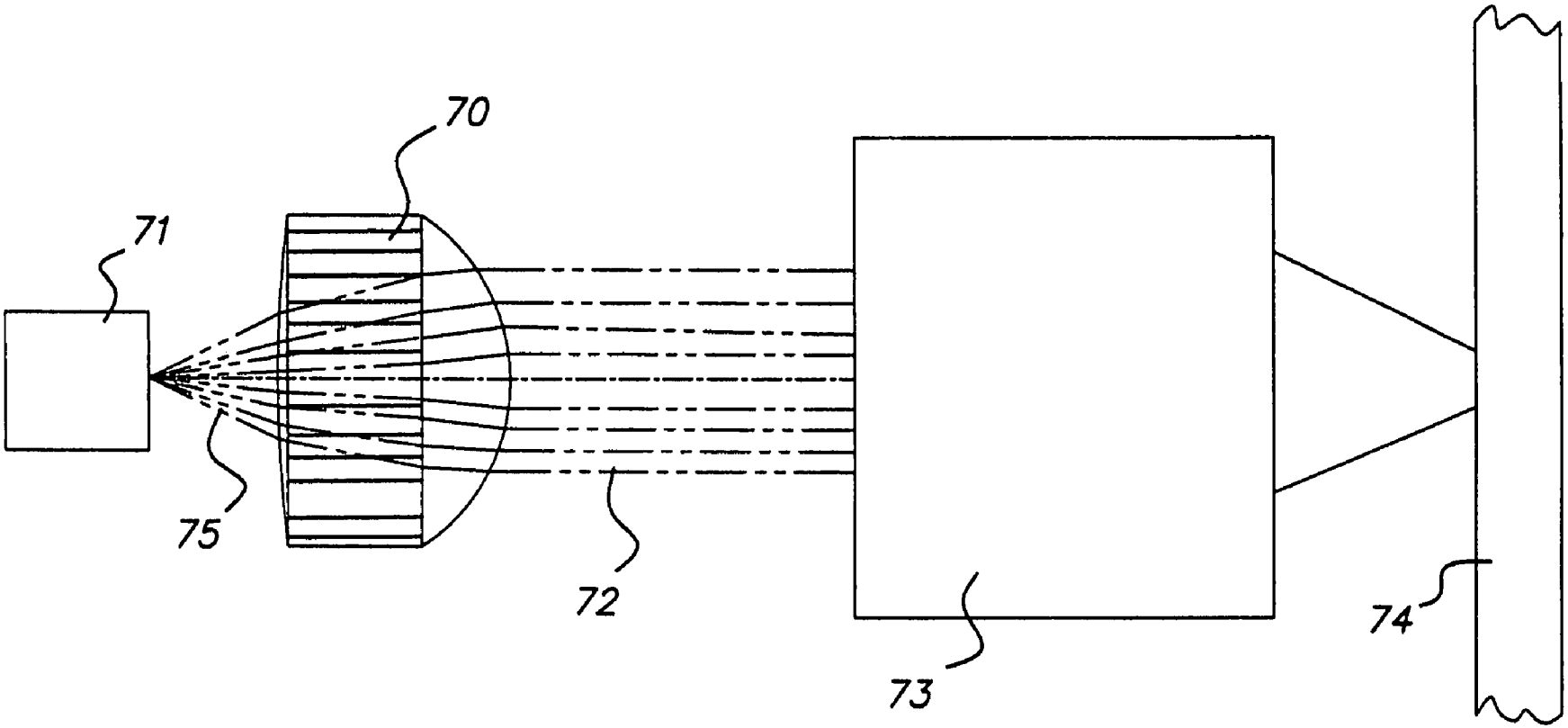
FIG. 7 is a diagram showing a collimating lens collimating the radiation from a diode laser.

FIG. 7 depicts laser beam 75 emitted from diode laser 71 and collimated with collimating lens 70. A subsequent optical system 73 may be placed in the path of beam 72 to image the beam on engraved media 74. The optical system 73 may also include elements for shaping the laser beam 72 that emerges from the collimating lens as a circle. The laser beam 75 emerging from a laser diode has an elliptical cross section by nature.

Figure 8:
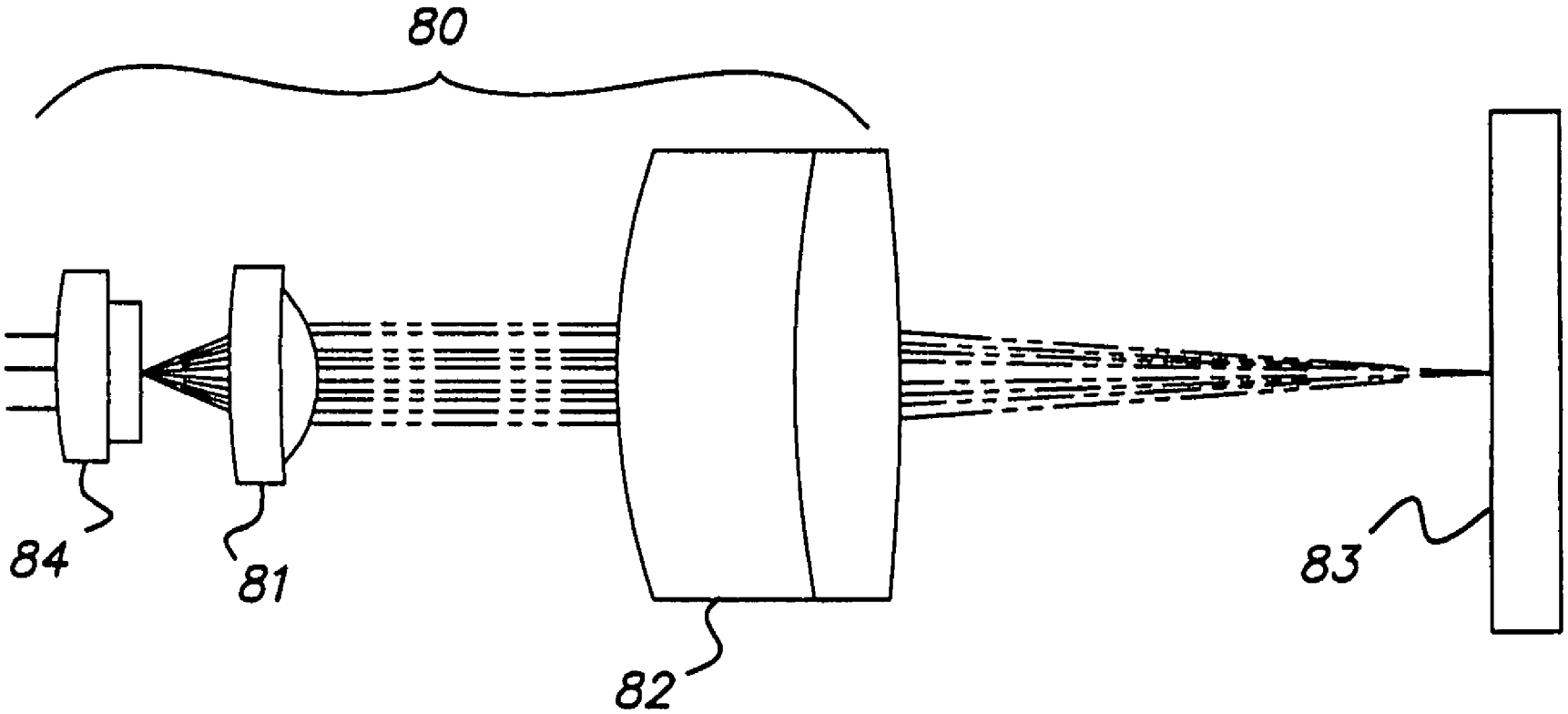
FIG. 8 is a diagram showing radiation from a coupled diode laser being collimated and imaged onto the flexographic plate.

FIG. 8 shows non-fiber coupled diode optics 80, including diode laser 84, collimating lens 81 and imaging lens 82 for imaging on engraved media 83.

Figure 9:
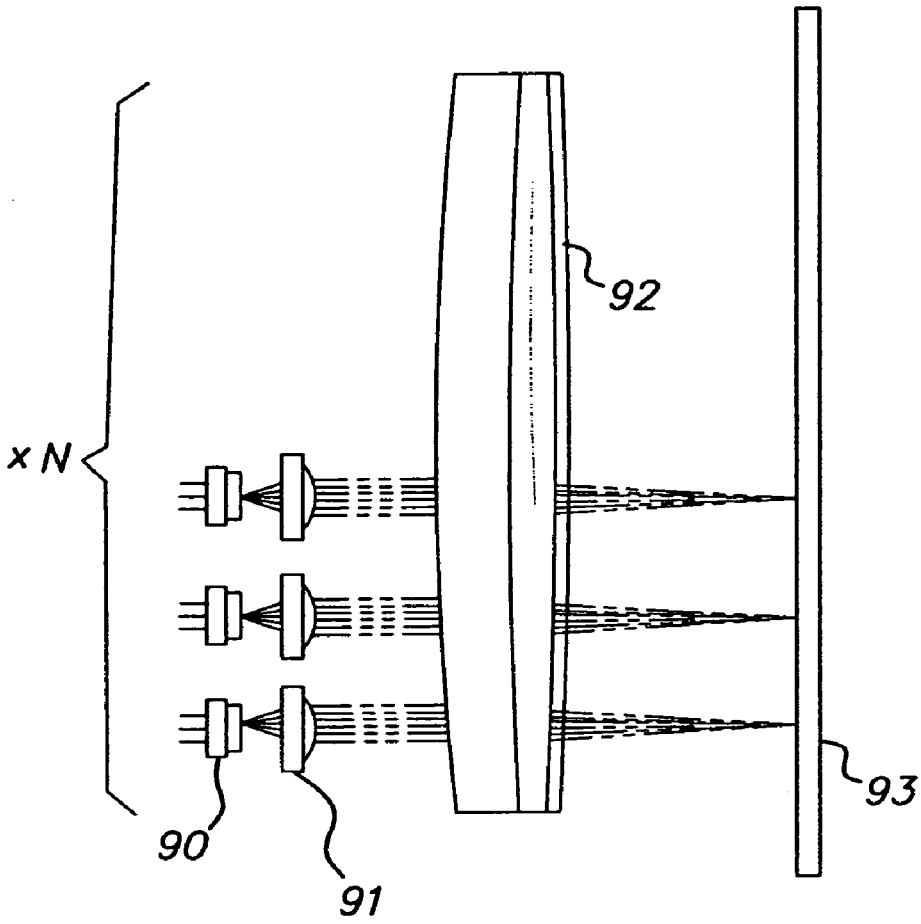
FIG. 9 is a diagram showing a plurality of coupled diode lasers being individually collimated and imaged onto the flexographic plate.

FIG. 9 shows one or more diode lasers 90 formed in a well-defined array. As with the case of a single diode laser, light from each diode 90 is captured by a respective collimating lens 91. Light from the array of collimated ( ) lenses 91 is captured into the imaging lens system 92 and then imaged on the engraved media 93.

A broad laser source can be constructed from fiber coupled or non-fiber coupled semiconductor laser bars or stacks such as available for example from: http://www.dilas.de/products/products.html, as well as from: http://www.scd.co.il/lapid.asp A laser bar emits light from a relatively large area, the width of which is typically 10 or 12 mm, and consists of an array of sub emitters. The total output power of a bar reaches 50 Watts or more.

Figure 10:
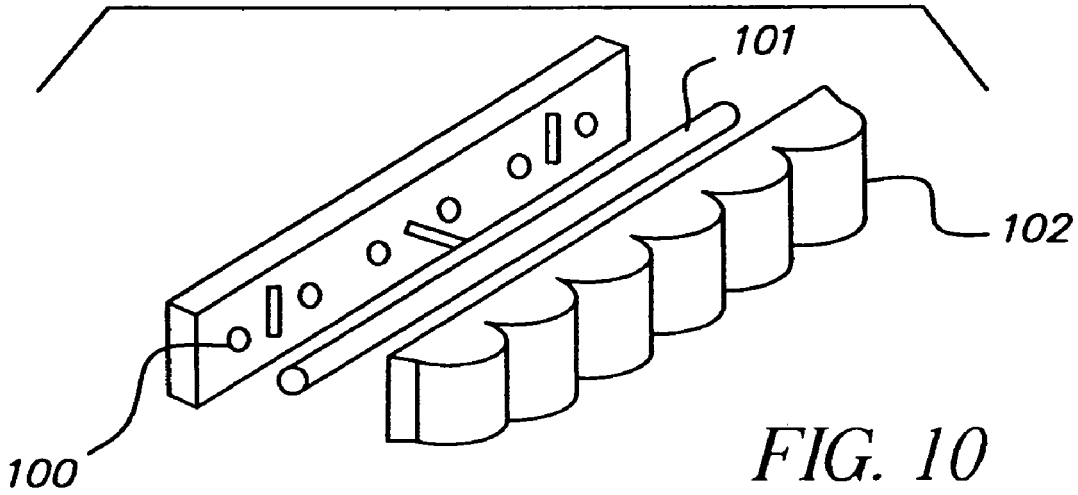
FIG. 10 is a diagram of a fast and slow axis collimation of a semiconductor laser bar.

FIG. 10 describes a laser bar 100 with multiple emitters. In order to collimate light, the optical system consists of a lens 101 that collimates the fast (axis of the angular span of 65 degrees, and an additional lens 102 that collimates the slow axis, it contains cylindrical elements in front of each individual emitter.

Figure 11A:
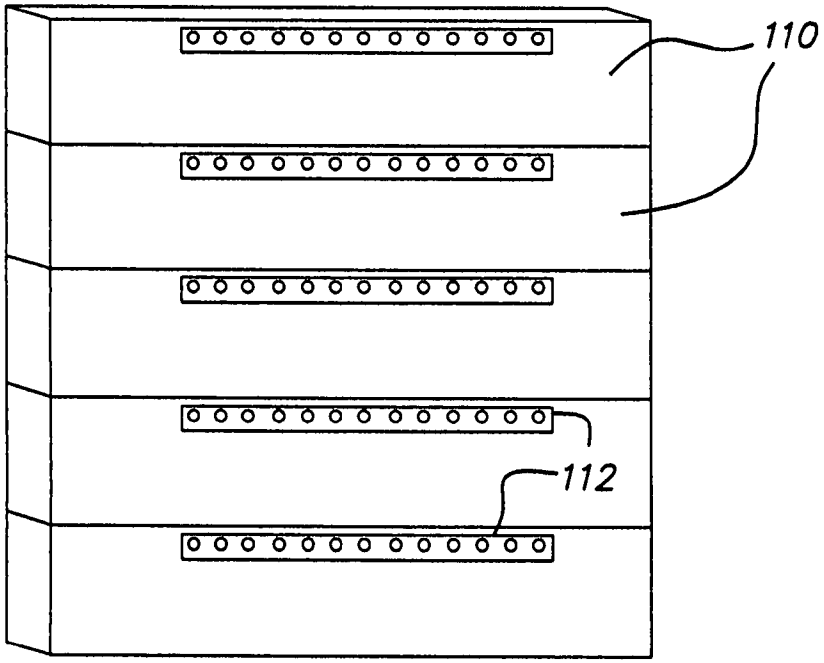
FIG. 11 is a diagram of fast vertically and horizontally stacked laser bars.
Figure 11B:
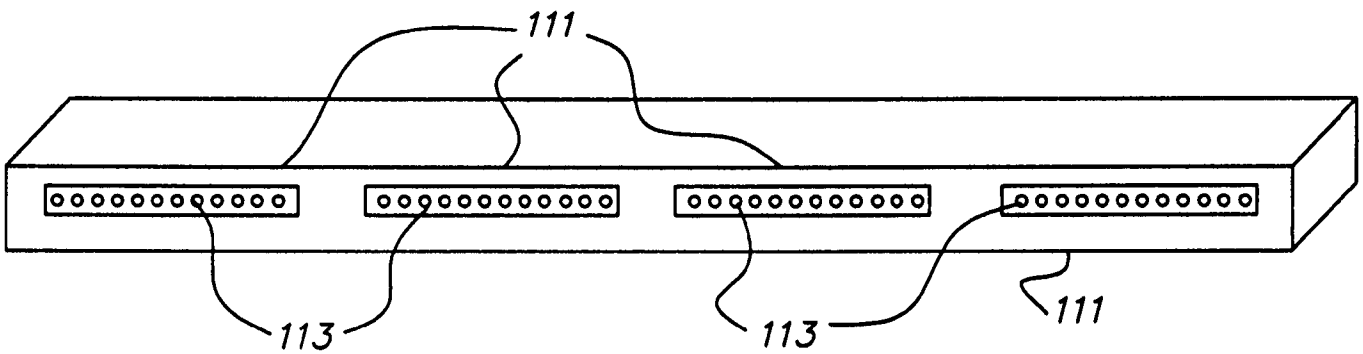

FIG. 11A shows several bars 110 that are coupled vertically and FIG. 11B shows several bars 111 that are coupled horizontally. Each bar 110 and 111 is configured with an array of emitters 112 and 113, respectively. The output power generated by bars 110 is the sum of the output powers generated by all individual bars. The bars 110 and 111 may be individually addressable.

Optical elements such as polarization and/or wavelength dependent beam combiners can be further used to combine the light from several such laser devices in order to increase the brightness of the broad laser source. The light emitted from these bars can be coupled by utilizing various micro-optical elements into fibers or a bundle of fibers. The fiber coupled or non-fiber coupled source is then imaged to a desired spot size, which is broad relative to the fine spot. This laser spot is then used to ablate the coarse structure of the flexographic printing plate to the required relief.

Figure 12:
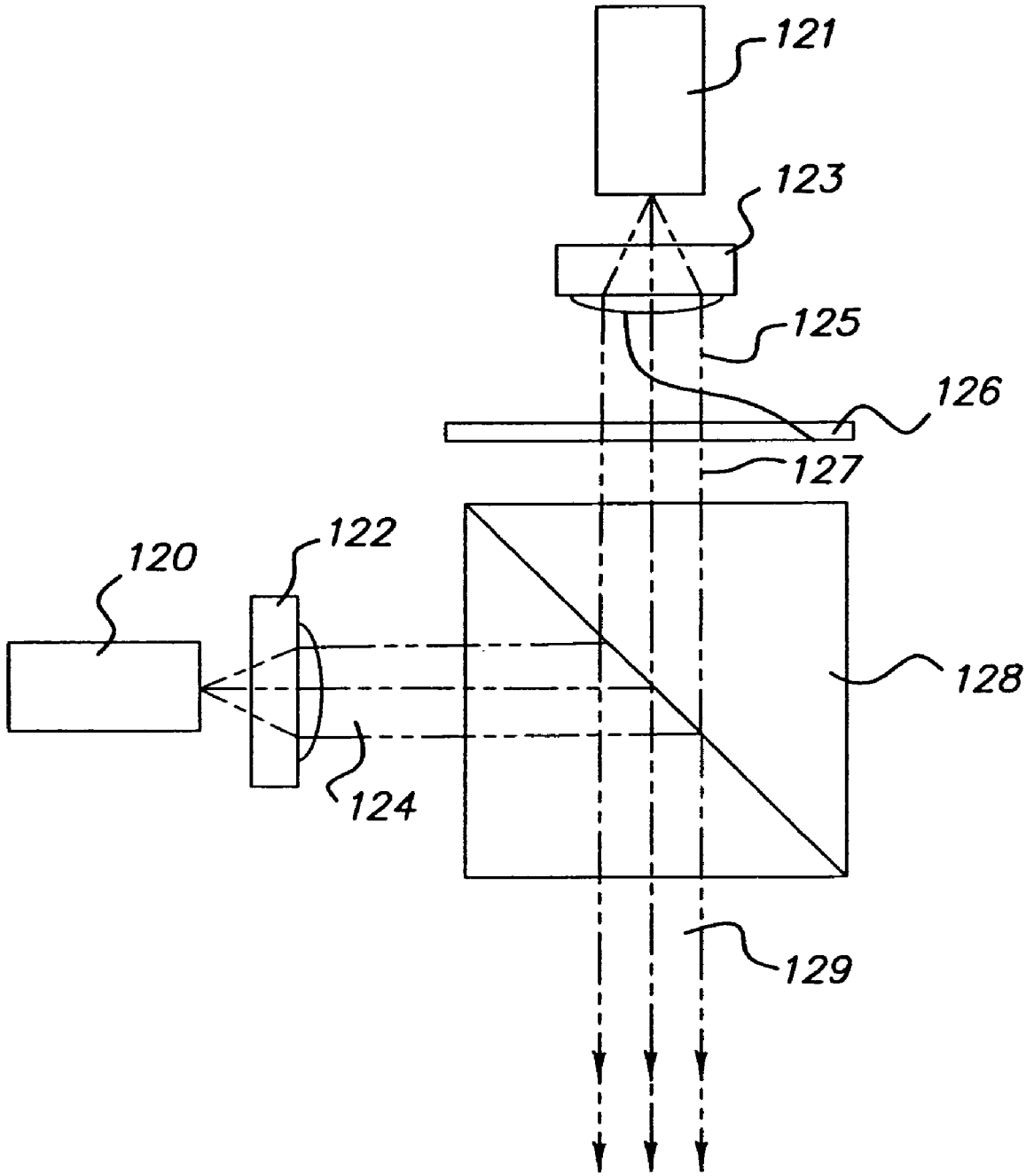
FIG. 12 is a diagram showing beam combination by using a polarization beam combiner.

An example of combining light polarization is described in FIG. 12. The laser beam 124 is a collimated laser beam from laser source 120 coupled to collimating lens 122. The beam enters to polarizing beam combiner (PBC) 128. The orientation of the PBC and laser source 120 is such that the output from PBC is at right angles to its original direction.

The beam 125 from laser source 121 coupled to collimating lens 123 is similar to laser beam 124. The beam 125 enters polarization half wavelength retarding waveplate 126. The emerging beam 127 has its state of polarization rotated by 90 degrees. By entering the PBC 128, beam 127 is transmitted and combines with beam 124 to form the combined output beam 129.

When using laser diodes that emit light at different wavelengths, the light sources may be tailored to the special optical and thermal characteristics of a direct engraving printing plate, such as the printing plate described in co-owned U.S. patent application Ser. No. 11/353,217.

The invention has been described in detail with particular reference to certain preferred embodiments thereof, but it will be understood that variations and modifications can be effected within the spirit and scope of the invention.

PARTS LIST

5 flexographic plate
10 ink transfer areas
11 blank areas
20 pressure
21 imaging features
22 imaging features
23 contact surface
24 flexographic plate
25 large blank areas
26 small blank areas
30 rotating drum
31 fine laser source
34 control device
36 broad laser source
38 carriage
39 carriage
40 flexographic plate
41 carriage
42 fine laser source

43 broad laser source
44 controller device
45 drum
46 flexographic plate
50 diode laser
52 fiber
54 imaging optical system
55 engraved media
60 fibers
61 system of lenses
62 engraved media
63 diode lasers
70 collimating lens
71 diode laser
72 laser beam
73 optical system
74 engraved media
75 laser beam
80 optics
81 collimating lens
82 imaging lens
83 engraved media
84 diode laser
90 diode lasers
91 collimating lens
92 lens system
93 engraved media
100 laser bar
101 lens
102 additional lens
110 bars
111 bars
112 emitters
113 emitters
120 laser source
121 laser source
122 collimating lens
123 collimating lens
124 laser beam
125 beam
126 retarding wave plate
127 emerging beam
128 polarizing beam combiner
129 output beam

The invention claimed is:

1. A system for 3D engraving flexographic printing plates, comprising:

a first group of two or more fiber coupled diode lasers each emitting radiation having substantially the same intensity wherein the ends of said fiber coupled diodes are arranged in an array;

a first one or more optical elements coupled to the first group of one or more radiation sources for imaging the radiation emitted from the first group of one or more radiation sources onto a flexographic printing plate;

a second group of two or more coupled diode lasers each emitting radiation having substantially the same intensity wherein the ends of said fiber coupled diodes are arranged in an array and said first group and said second group diode lasers emit radiation having same wavelength; and a second one or more optical elements coupled to the second group of two or more coupled diode lasers for imaging the radiation emitted from the second group of two or more coupled diode lasers onto the flexographic printing plate, wherein the intensity and spot size of the first group of two or more coupled diode lasers is different from the intensity and spot size of the second group of two or more coupled diode lasers, and wherein said first and second groups of coupled diode lasers operate simultaneously.

2. The system of claim 1, wherein the diode lasers include, multi emitter laser diodes, laser bars, laser stacks, or fiber lasers.

3. The system of claim 1, wherein the first one or more optical elements include a telecentric lens.

4. The system of claim 3, wherein the second one or more optical elements include a telecentric lens.

5. The system of claim 1, wherein the first one or more optical elements include at least one collimating lens.

6. The system of claim 5, wherein the second one or more optical elements include at least one collimating lens.

7. The system of claim 1, wherein the first one or more optical elements include an array of collimating lenses.

8. The system of claim 7, wherein the second one or more optical elements include an array of collimating lenses.

9. The system of claim 1, wherein a first and second group of one or more radiation sources are mounted on a single movable carriage.

10. The system of claim 1, wherein a first and second group of one or more radiation sources are mounted on a first and second movable carriage, respectively.

11. The system of claim 1, wherein the radiation from the first group of one or more radiation sources is combined into a single optical path.

12. The system of claim 11, wherein the radiation from a second group of one or more radiation sources is combined into a single optical path.

13. The system of claim 1, wherein the first group of one or more radiation sources is capable of engraving fine details on the flexographic printing plate.

14. The system of claim 13, wherein a second group of one or more radiation sources is capable of engraving broad details on the flexographic printing plate.

* * * * *